United States Patent [19]

Teal

[11] Patent Number: 5,005,111

[45] Date of Patent: Apr. 2, 1991

[54] PURSE LIGHT ASSEMBLY

[76] Inventor: Chuck Teal, P.O. Box 1134, Walkertown, N.C. 27051

[21] Appl. No.: 511,234

[22] Filed: Apr. 19, 1990

[51] Int. Cl.[5] ..... A45C 15/06

[52] U.S. Cl. ..... 362/156; 362/190; 362/802; 150/102

[58] Field of Search ..... 362/154, 156, 190, 191, 362/205, 802; 150/102

[56] References Cited

U.S. PATENT DOCUMENTS

| | | | |
|---|---|---|---|
| 919,385 | 4/1909 | Ruthven | 362/156 |
| 1,738,243 | 12/1929 | Hedberg | 362/190 |
| 3,045,900 | 7/1962 | Zekendorf | 362/156 |
| 3,171,109 | 2/1965 | Appel | 362/802 |
| 3,808,416 | 4/1974 | Pottratz . | |
| 3,893,096 | 7/1975 | Tucci et al. | 150/102 |
| 4,091,443 | 5/1978 | Ohrenstein et al. | 362/156 |
| 4,332,007 | 5/1982 | Gibstein et al. | 362/156 |
| 4,432,041 | 2/1984 | Pfisterer et al. | 362/802 |
| 4,654,763 | 3/1987 | Knight | 362/156 |
| 4,742,438 | 5/1988 | King | 362/156 |
| 4,885,570 | 12/1989 | Chien | 150/102 |

*Primary Examiner*—Ira S. Lazarus
*Assistant Examiner*—Sue Hagarman
*Attorney, Agent, or Firm*—Terry M. Gernstein

[57] ABSTRACT

A light assembly is used in a purse and is releasably attached to one inside surface of such purse by a hook-and-loop fastener. The light includes a switch which automatically turns on the light as soon as the purse is opened, and includes an alarm system that generates an audible signal after a pre-set time interval after the purse is opened unless the alarm is de-activated manually.

1 Claim, 2 Drawing Sheets

PURSE LIGHT ASSEMBLY

TECHNICAL FIELD OF THE INVENTION

The present invention relates to the general art of lights, and to the particular field of special purpose flashlights.

BACKGROUND OF THE INVENTION

Many women carry their belongings in a purse. Whenever this purse is opened, there are shadows in the purse, even in bright light, and especially in darkened areas, such as a dark room or the like. These shadows make finding a small item, such as a house key, difficult.

Accordingly, many women carry a flashlight in their purse. However, such lights must be small so as not to take up an inordinate amount of room, especially if the purse is small. Thus, finding the flashlight itself can be a difficult task, thereby vitiating the advantages of the light. Still further, if the light is difficult to activate, as because it has a small, difficult-to-reach switch, the advantages associated therewith are further inhibited.

Still further, many woman suffer from purse snatchings. Therefore, there is a need for a means for inhibiting such occurrences.

If the light is small, it can become lost in the clutter of many other items that may be in the purse. If the user must search for the light, its effectiveness is undermined.

Accordingly, there is a need for a device which is small, yet which can be used to not only provide light in a purse, but can also be used as a means for inhibiting loss of the purse as by purse snatching.

OBJECTS OF THE INVENTION

It is a main object of the present invention to provide a purse light that is easily accessible.

It is another object of the present invention to provide a device which is small, yet which can be used to not only provide light in a purse, but can also be used as a means for inhibiting loss of the purse as by purse snatching.

SUMMARY OF THE INVENTION

These, and other, objects are achieved by a purse light that includes a hook-and-loop fastener means for attaching it to an inside surface of the purse and also includes an alarm means that is activated as soon as the purse is opened and will sound if it is not disabled within a prescribed time period. The light further includes a reverse switch which automatically turns on the light and activates the alarm system as soon as the purse is opened, and the alarm system can include a manual override system.

In this manner, the light will be accessible, easy to use and can serve a further purpose of protecting the purse from a snatching.

DETAILED DESCRIPTION OF THE PREFERRED EMBODIMENT OF THE INVENTION

Figure 1:
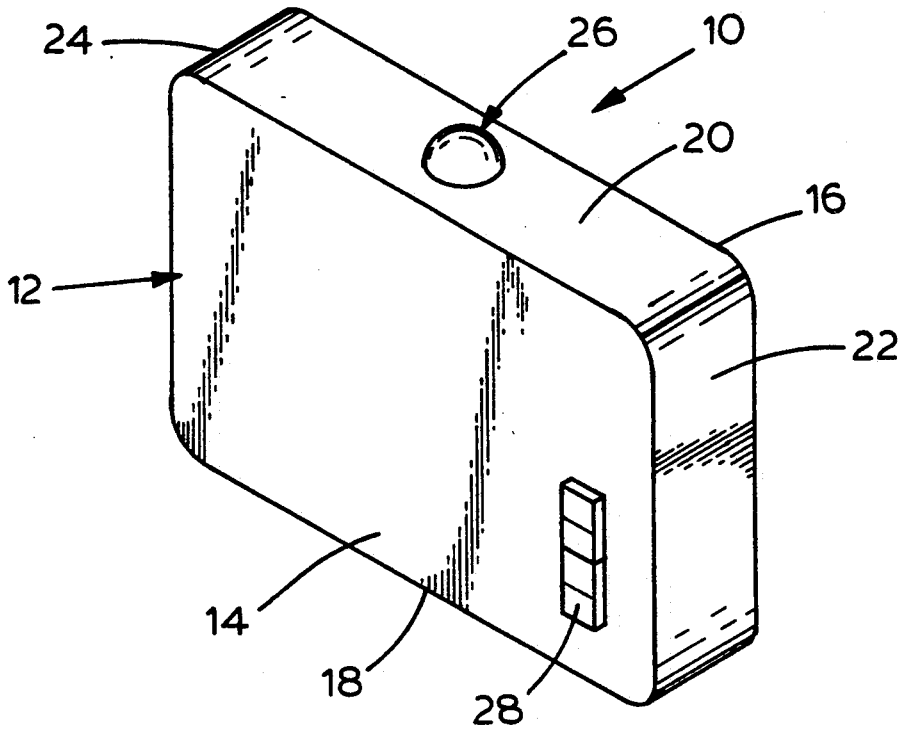
FIG. 1 is a front perspective view of a purse light embodying the present invention.

Shown in FIG. 1 is a purse light 10 which includes a monolithic case 12 having a front side 14, a back side 16, a bottom 18, a top 20, and ends 22 and 24.

The light 10 includes a bulb assembly 26 on the top 20 and a manually actuated switch 28 on the front side 14. A battery (not shown) is stored in the case, and appropriate leads connect the switch to a bulb (not shown) in the bulb assembly so that activation of the switch will activate the light.

Figure 2:
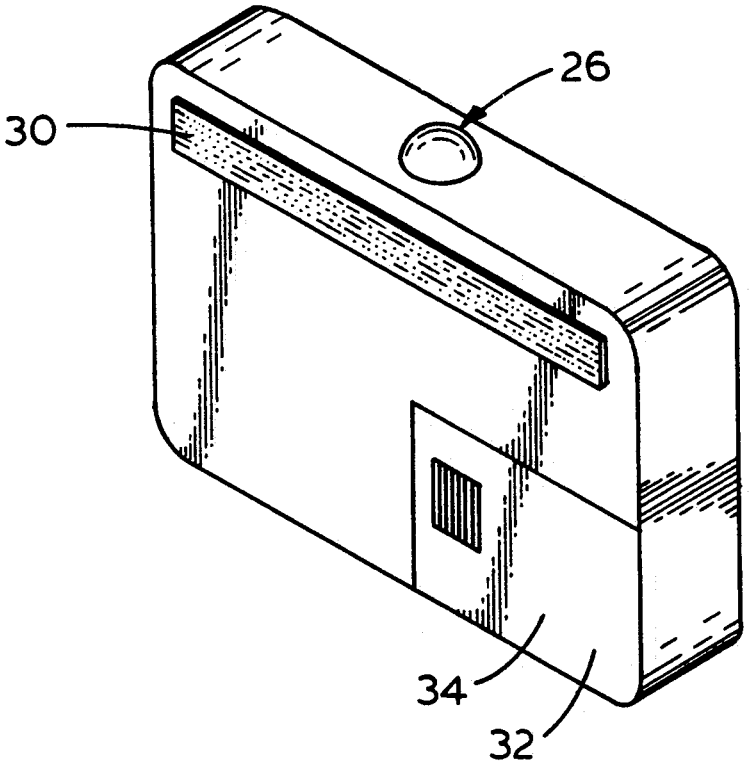
FIG. 2 is a rear perspective view of the purse light.

As shown in FIG. 2, the light 10 includes a means to attach the case to an inside surface of a purse. This means includes a hook-and-loop fastener means 30 that co-operates with another hook-and-loop fastener means on the purse inner surface to releasably hold the light 10 in place. The user will always know where the light is and there is little danger of the light becoming lost in the items that are normally carried in a purse.

The batteries used to power the light are stored in a battery compartment 32 that is covered by a removable cover 34. It is also possible to have a disposable light that is thrown away when the batteries are depleted so no battery compartment is necessary in such a situation.

Figure 3:
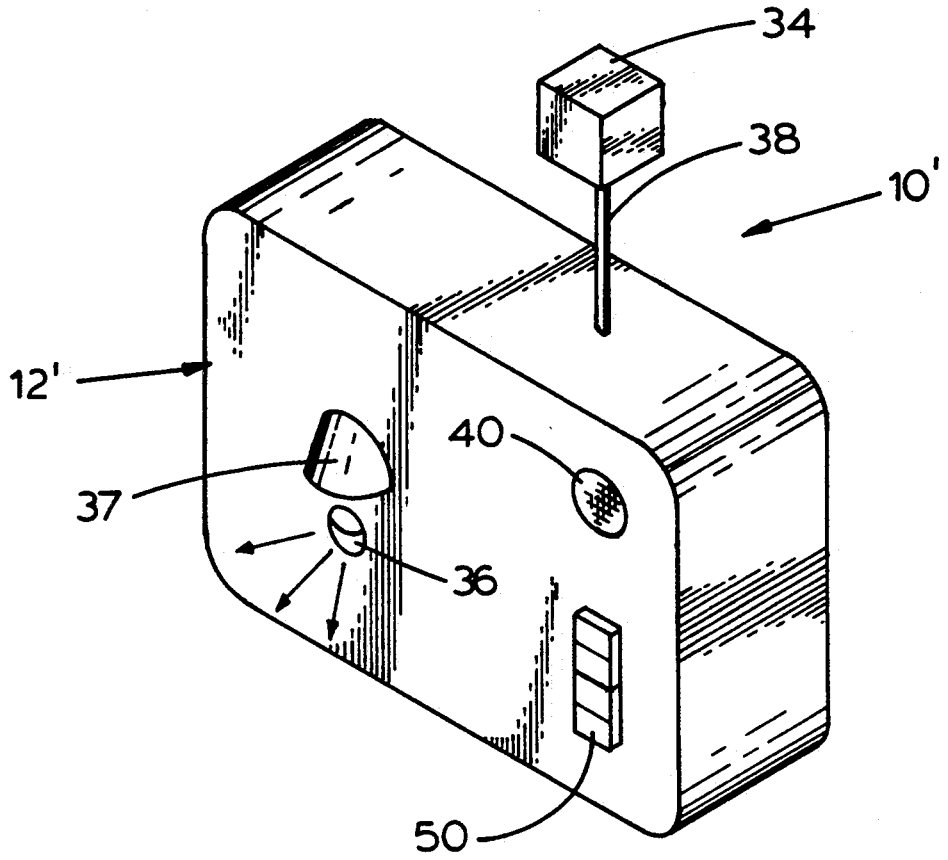
FIG. 3 is a front perspective view of an alternative embodiment of the purse light embodying the present invention.
Figure 4:
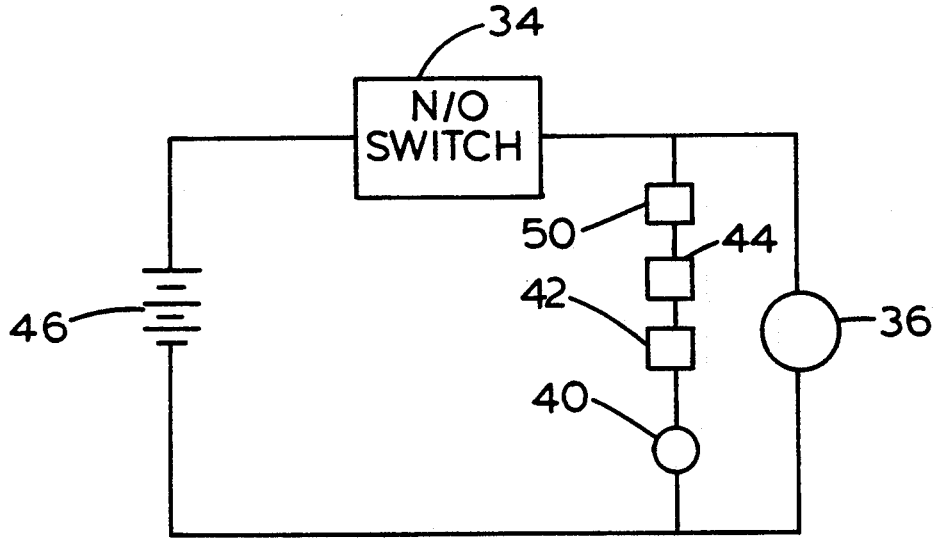
FIG. 4 is a circuit diagram of the FIG. 3 purse light system.

An alternative form of the purse light is shown in FIGS. 3 and 4, and attention is now adverted to such figures. The alternative light 10′ includes a means for automatically turning the light on when the user opens the purse, and an alarm system for inhibiting a purse snatching.

The means for automatically turning the light on includes a reverse switch 34 that prevents power from being applied to light bulb 36 located on the front side of the case 12′ when the purse is closed, but which closes the circuit between the power source and the light as soon as the purse is opened. Such reverse switches are well known in the switch art, and thus will not be further discussed. Reference is made to the circuit diagram shown in FIG. 4 for the operation of the reverse switch and the power application to the light bulb. The bulb 36 is positioned subadjacent to a hood 37 to direct the light from that bulb into the interior of the purse when the purse is opened.

The reverse switch is mounted on a pedestal 38 to be located in a position to be operated by the mouth portions of the purse as the purse is opened and closed.

The alternative embodiment of the purse 10′ also includes an alarm system which includes an audible signal generator, such as a horn 40, or the like. As indicated in FIG. 4, the alarm circuit includes a delay element 42 that is connected to the reverse switch via a manual over-ride element 44. The delay element will connect the horn 40 to battery 46 via the closed switch 34 after a preset time interval to signal that the purse has been opened. This function can be stopped by moving the manual over-ride element 44 to an inactive position thereby interrupting the circuit path to the horn. If the manual over-ride element is not operated, the alarm will sound. The purse owner will be able to de-activate the alarm switch when the purse is opened so that the horn will not be sounded; however, a purse snatcher will not know of the alarm circuit, and will not de-activate it, thereby having the alarm sound.

If the purse owner does not want to use the alarm circuit, a manually activated switch 50 is operated to de-activate the delay element.

The delay element includes an automatic re-set means to again set the delay function after the manual over-ride 44 has been operated and the purse re-closed so the entire function of the light 10' will be operative again. Thus, once the purse is opened, the manual over-ride element must be operated to prevent the alarm from sounding. Once this has occurred, the delay element will automatically recycle itself back to the initial condition to again activate the alarm after the pre-set delay once the purse is closed and then opened again.

It is understood that while certain forms of the present invention have been illustrated and described herein, it is not to be limited to the specific forms or arrangements of parts described and shown.

What is claimed:

1. A light assembly for use in a purse comprising:

(A) a case, said case having a front surface, a rear surface, a top surface, a bottom surface, and two side surfaces;

(B) a hook-and-loop fastener on said case rear surface mounting said case to an inner surface of a purse;

(C) a light element mounted on said case front surface;

(D) a hood element mounted on said case front surface above said light element, said hood element being shaped to direct light emitted from said light element downwardly toward said case bottom surface;

(E) a power source in said case;

(F) a manual on/off switch mounted on said case front surface adjacent to said light element;

(G) a horn element mounted on said case front surface adjacent to said manual on/off switch;

(H) a first circuit means connecting said light element to said power source, said first circuit means including a reverse switch that is biased into a circuit closing closed condition and is opened by overcoming said bias, said reverse switch being connected to said power source and to said light element, said reverse switch connecting said light element and said horn element to said power source when said reverse switch is closed and disconnecting said light element and said horn element from said power source when said reverse switch is held open;

(I) a second circuit means connecting said horn to said reverse switch and to said power source, said second circuit means including (1) a timer mechanism connected to said horn, (2) said manual on/off switch connecting said timer mechanism and to said reverse switch, (3) said timer mechanism connecting said horn to said reverse switch after a preset delay period after said reverse switch is closed, said manual on/off switch being connected between said timer mechanism and said horn to disconnect said horn from said power source when manually operated into an off condition whereby said manual on/off switch serves as a manual over-ride to prevent said horn from being activated even after said preset time has elapsed if said manual on/off switch is in an off condition;

(4) said timer mechanism, said manual on/off switch and said horn all being connected in series with each other and said series connected timer mechanism, said manual on/off switch and said horn being connected in parallel with said light element with respect to said reverse switch so that said light element will be activated even if said manual on/off switch is in an off condition to disconnect said timer mechanism from said power source;

(J) a pedestal mounted at one end thereof on said case top surface and extending upwardly therefrom and having a second end located spaced from said case top surface; and (K) a housing mounted on said pedestal second end, said reverse switch being located in said housing to be contacted by a mouth element of a purse to hold said reverse switch open when the purse is closed and to permit said reverse switch to close when the purse is opened.

* * * * *